United States Patent [19]

Yamazaki et al.

[11] 4,138,765

[45] Feb. 13, 1979

[54] THERMOPLASTIC RESIN HANDLES FOR VEHICLE DOORS

[75] Inventors: Takeo Yamazaki, Anjo; Kuniyoshi Harada, Toyota, both of Japan

[73] Assignee: Aisin Seiki Kabushiki Kaisha, Kariya, Japan

[21] Appl. No.: 705,954

[22] Filed: Jul. 16, 1976

[30] Foreign Application Priority Data

Jul. 22, 1975 [JP] Japan ..... 50-89456

[51] Int. Cl.[2] ..... E05B 1/00

[52] U.S. Cl. ..... 16/110 R; 74/545; 156/73.1

[58] Field of Search ..... 16/110 R, 121, 118; 292/347; 156/73.1, 303.1; 428/31, 40, 41; 74/545, 543, 553

[56] References Cited

U.S. PATENT DOCUMENTS

| | | | |
|---|---|---|---|
| 1,913,026 | 6/1933 | Graff | 74/545 |
| 2,007,555 | 7/1935 | Wiltshire, Jr. | 16/121 UX |
| 2,127,043 | 8/1938 | Most | 156/303.1 X |
| 2,247,558 | 7/1941 | Nichols | 156/303.1 |
| 2,306,867 | 12/1942 | Dean | 292/347 |
| 2,537,782 | 1/1951 | Meyers | 74/553 UX |
| 2,567,565 | 9/1951 | Keeler et al. | 292/347 |
| 3,184,353 | 5/1965 | Balamuth et al. | 156/73.1 |
| 3,440,117 | 4/1969 | Soloff et al. | 156/73.1 |

FOREIGN PATENT DOCUMENTS

| | | | |
|---|---|---|---|
| 77116 | 7/1919 | Austria | 292/347 |
| 1532572 | 6/1968 | France | 292/347 |
| 930895 | 7/1963 | United Kingdom | 292/347 |

*Primary Examiner*—Andrew V. Kundrat

*Attorney, Agent, or Firm*—Burns, Doane, Swecker & Mathis

[57] ABSTRACT

Method for making a thermoplastic resin handle for vehicle door and the resultant handle. The handle includes a handle body of the thermoplastic resin and a sheet metal covering the body. The metal sheet is secured to the face of the handle body by means of a plurality of projections in the back face of the sheet metal. Each projection is embedded in the layer of the resin of the handle body throughout its entire length to provide a better grip thereby. In the steps for embedding the projection in the resin body, supersonic waves are applied to the sheet metal to cause frictional vibrational movement relative to the handle body and to, in turn, cause heat sufficient to melt a zone of the body necessary to plunge each projection into the handle body.

6 Claims, 8 Drawing Figures

THERMOPLASTIC RESIN HANDLES FOR VEHICLE DOORS

BACKGROUND OF THE INVENTION

This invention relates in general to a method of ornamenting synthetic resin products and more in particular to a handle made of thermoplastic resin which is well adapted for use in a handle of a window glass regulator for vehicles and the like, and simulates the real or genuine metal handles of this type and which has a very splendid and attractive brightness in appearance.

It has been the practice in the art that most of the handles of this type have been made of zinc or zinc base alloy by the known die casting technique. Such zinc or zinc base alloy handle is characterized by a comparatively lighter nature and readiness for application of conventional plating technique. The plating is not only for the purpose of achieving a splendid and attractive bright appearance which is customarily demanded by a wider public but also to meet otherwise a requirement to have an occupant become aware of the location of the handle even though in dark circumstances within the vehicle particularly at night.

Due to cheaper and smaller weight of the synthetic resin handles, many substitutes for all metallic handles have been tried in the art, but none of the synthetic resin handles has been found to equal it for the special purpose herein described, that is for continuing ability to simulate the all metallic handles during the service life particularly with respect to a splendid and attractive brightness in appearance.

The special object of the invention therefore is the production of a thermoplastic resin handle which is as well suited to this purpose as the metallic handles in appearance.

A further object of the invention is the production of the thermoplastic resin door handle simulating the conventional metallic handle in appearance but having certain properties of the advantageous thermoplastic resin products particularly with a view to saving substantial manufacturing costs and decreasing the weight of the resulting handle and thereby rendering the resulting handle superior in this respect to the conventional all metallic handle.

Various method have been provided for the synthetic resin products in simulating the all metallic products in appearance by coating or ornamenting the synthetic resin products with a metallic film or sheet as described below.

1. affixing a thin gauge sheet metal to the surface of the synthetic resin products by means of some affixing material commercially available
2. securing a thin gauge sheet metal by fitting to a contoured recess in the face of products to a closely similar contour of the sheet metal
3. plating the synthetic resin products with melting metal of desired appearance.
4. covering or coating the synthetic resin products with the sheet metal by means of the known inserting technique
5. securing the sheet metal to the surface of the synthetic resin products by pressing it against the surface under a heated and softened or molten condition of the synthetic resin material In actual use, the handle is required to have a certain strength against the load. For meeting such requirement, there has been usually preferred in the art the known polyacetal synthetic resin for forming the handle.

In actual test, none of the above mentioned five methods 1 to 5 has proven to be sufficient for the polyacetal resin products to be applied, even though they have been found applicable to various resins other than the polyacetal resin.

In detail, the above methods 3 and 5 have been found difficult in application to the polyacetal resin products, because of its peculiar properties.

The method 1 has proven to be inferior in durability, i.e., service life of the resultant products.

With the method 4, it is difficult to hold the metal sheet in the covering position when the method is applied.

The method 2 also has proven to be insufficient in the durability of the resultant products produced as is the products by the method 4. For freedom from such drawback, there will be required to apply some additional steps to the resultant product.

SUMMARY OF THE INVENTION

The principal object of the invention is therefore to provide a method which is properly applicable to various plastics not only of polyacetal resin but also of the other thermoplastic resins for securing a sheet metal onto their surfaces by applying supersonic waves to the plastics with the sheet metal held in properly pressed condition relative thereto.

Another object of the invention is to provide a thermoplastic resin handle for vehicles having a special property which simulates the usual all metallic handle in appearance, but has certain characteristics and peculiar properties of the thermoplastic resin which suit the purpose.

The foregoing objects and others are attained according to at least one aspect of the present invention through provision of projecting portions extended from the back face of the sheet metal to be embedded in the layer of the thermoplastic resin of the products by applying supersonic waves to the products with the sheet metal held in pressed relation to the products across the projecting portions.

With these and other objects in view, the thermoplastic resin products of the present invention comprise generally a body made of the resin and a thin gauge sheet metal firmly secured to a face of the body to cover the same by means of a suitable number of projections protruding from the back face of the sheet metal and embedded in the underlying layer of the resin so as to be held firmly captive therein.

The method for forming such a thermoplastic resin product includes an essential step of applying supersonic waves to the product and the sheet metal in suitably pressed relation therebetween across the projections in the back face of the sheet metal. When the critical factors of time within which the sheet metal and thermoplastic resin body are exposed to the supersonic waves and the pressure between them are controlled within limits, the resultant product is firmly coated or covered with a thin gauge sheet metal with the projections embedded in the layer of the resin so as to hold thereof firmly tightly captive therein.

FIGS. from 4*a* to 4*c* are views in elevation showing various types of projection protruding from the back of the sheet metal to be embedded in the layer of the resin.

Figure 5:
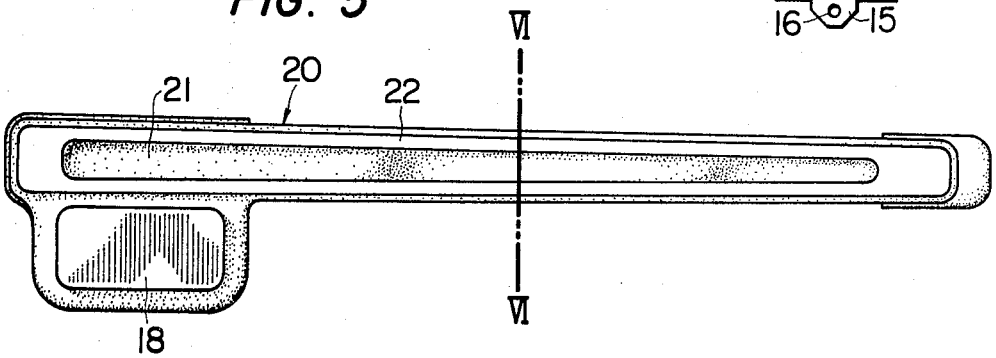

FIG. 5 is a front elevation of another embodiment of the invention, and

Figure 6:
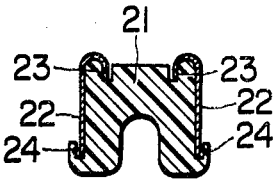

FIG. 6 is a somewhat enlarged transverse section on line VI—VI of FIG. 5.

DESCRIPTION OF PREFERRED EMBODIMENTS

In the accompanying drawing, the invention has been illustrated as embodied in a handle of window glass regulator for vehicles. It will be noted that the improvements are capable of wider variation and adaptation, both in the matter of uses and in design.

Figure 1:
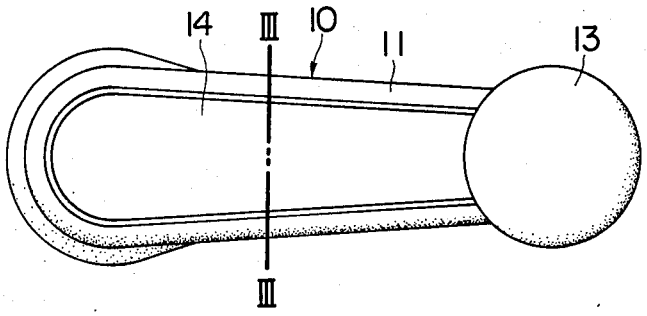
FIG. 1 is a front elevation of a handle embodying the present invention.
Figure 2:
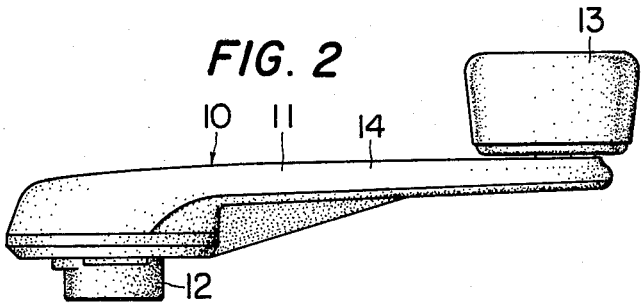
FIG. 2 is a side view of the handle of FIG. 1.
Figure 3:
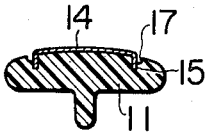
FIG. 3 is a cross sectional view taken along the line III—III in FIG. 1.
Figure 4A:
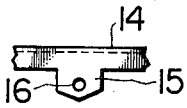
Figure 4B:
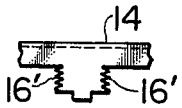
Figure 4C:
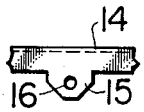

In FIGS. 1 and 2, a body or arm 11 of the door handle generally indicated at 10 is provided at the left extremity with a shaft portion 12 and at the other end a knob 13 rotatingly mounted on the opposite side to that on which is located the shaft 12. The shaft 12 is to be connected operatively to the known device (not shown) to manually crank up or lower the window glass by an occupant. As shown in FIG. 3, a thin gauge sheet metal 14 is secured to the arm 11 so as to cover or coat a portion of the same by means of suitable number of projections 15 protruding from the back face of the sheet 14. The projections 15 are shown in greater detail in FIGS. 4*a* to 4*c*. Each projection is provided with indentations 16' or perforations 16 in order to provide a better capture in the layer of thermoplastic resin of the arm 11 to obtain a desired firm connection between the sheet metal and the arm 11.

In the method, the arm of thermoplastic resin such as, for example, the polyacetal resin is exposed together with the sheet metal to the supersonic waves with each projection 15 held in abutment or pressed in contact with arm body 11 under a suitable pressure. In this condition, the thermoplastic resin body 11 is molten at a portion immediately adjacent to each projection by heat resulting from frictional vibrational movement of the sheet metal relative to the arm body 11 effected by the supersonic waves. Each projection is accordingly plunged into the molten portion of the arm 11 throughout its entire length, until the back face of the sheet metal abuts against the face of the arm 11. In this technique, the resulting molten portion in the arm is limited to a necessary minimum zone to permit each projection to be plunged into the body, no marginal excessive zone being molten. This is very beneficial to obtain the desired result of superior appearance.

In FIGS. 5 and 6, there is shown another embodiment of the invention. The handle 20 is for use in controlling the opening and closing of the vehicle door for ingress or egress of the person. As will be seen in FIG. 6, the handle 20 has an arm 21 covered at both sides and also both ends (FIG. 5) by a sheet metal 22 extending throughout the entire length of the arm 21 for simulating the metal handle in appearance. As shown in FIG. 6, the sheet metal 22 is bent inward along the upper edge 23 which is held captive in the layer of the resin of the arm by applying the same technique as the first embodiment in FIGS. 1 to 4. The other edge 24 of each side of the sheet metal is also captive in the layer of the resin arm 21 of the resultant handle. A push button 18 is provided for releasing a lock of the door to open the vehicle door.

It should be noted that the handle 20 is secured to the external side of the vehicle door for opening the door by a person outside the vehicle. Further it should be noted that the handle has a U-shaped configuration and the ends are secured to the vehicle door so that a suitable clearance is ensured between the face of the door and the middle portion of the handle 20 to provide a sufficient grip.

In order to hold the sheet metal in the desired position during the period of application of the supersonic waves, the arm 11 is beneficially provided with a groove or slit 17 (FIG. 3) along the contour of the sheet metal. The slit 17 provides means to prevent the sheet metal from freely moving out of the desired position by holding the projections in the slit until the application of the supersonic waves is ceased.

It should be noted that the perforation 16' or indention 16 of the projection 15 (FIGS. 4*a* to 4*c*) provides a good anchor for the projections 15 in the temporarily molten body portion of the thermoplastic resin arm 11 which well resists any force tending to separate the sheet metal from the arm 11. The same provision may be effectively applied to the embodiment of FIG. 5 for the same purpose.

What is claimed:

1. A handle structure for use on vehicles comprising a body member of slender form made from a thermoplastic resin, a shaft carried at one end of said body member, a knob rotatably carried at the other end, said knob disposed on a side of the body member opposite the shaft to define a crank-like handle adapted for use on a vehicle door to manually raise or lower a glass window on the door, and a sheet metal member covering a face portion of the body member on the same side as said knob, said sheet metal member including edges which define projections extending into said body member and each of which is provided with means for restraining said sheet metal member against separation from said body member, said projections being embedded in the underlying layer of the thermoplastic resin rendered temporarily molten by heat generated by frictional vibrational movement of the sheet metal member relative to said body member induced by application of supersonic wave energy.

2. A handle as set forth in claim 1 wherein said means for restraining said sheet metal member against separation from said body member is constituted by a perforation in each projection.

3. A handle as set forth in claim 1 wherein said means for restraining said sheet metal member against separation from said body member is constituted by indentations along the periphery of each projection.

4. A handle as set forth in claim 1 wherein the edge portions of said sheet metal are seated in correspondingly located grooves in said thermoplastic resin body member and which serve to guide the edges while the projections thereon are being embedded.

5. A handle structure for use on vehicles comprising a body member of slender form and rectangular section made from a thermoplastic resin, said body including oppositely disposed faces and a longitudinally extending sheet metal member covering each said face of the body member, said sheet metal members each including opposite edges which define projections extending into said body member and each of which is provided with means for restraining said sheet metal member against captive separation from said body member, said projections being embedded in the underlying layer of the thermoplastic resin rendered temporarily molten by heat generated by frictional vibrational movement of the sheet metal member relative to said body member induced by application of supersonic wave energy.

6. A handle structure for use on vehicles comprising a body member made from a thermoplastic resin and including a face portion and a plurality of guide grooves therein, and a sheet metal member covering a face portion of the body member, said sheet metal including opposite edges having projections and which edges extend into said guide grooves of said body member and each projection is provided with means for restraining said sheet metal member against separation from said body member, said projections while guidingly seated in said grooves, being embedded in the underlying layer of the thermoplastic resin rendered temporarily molten by heat generated by frictional vibrational movement of the sheet metal member relative to said body member induced by application of supersonic wave energy.

* * * * *